United States Patent [19]

Mandock

[11] 4,000,961

[45] Jan. 4, 1977

[54] PRIMARY FLAME SAFEGUARD SYSTEM

[75] Inventor: Richard F. Mandock, Rockford, Ill.

[73] Assignee: Eclipse, Inc., a corporation of Illinois, Rockford, Ill.

[22] Filed: Aug. 26, 1975

[21] Appl. No.: 607,917

[52] U.S. Cl. ..... 431/2; 307/117; 431/78; 431/80; 431/25

[51] Int. Cl.[2] ..... F23N 5/12

[58] Field of Search ..... 431/78, 80, 79, 25, 431/26, 24, 2; 307/117

[56] References Cited

UNITED STATES PATENTS

| | | | |
|---|---|---|---|
| 3,445,172 | 5/1969 | Zielinski | 431/78 X |
| 3,644,074 | 2/1972 | Cade | 431/26 |
| 3,681,681 | 8/1972 | Auslander | 431/26 X |
| 3,701,137 | 10/1972 | Hulsman | 431/80 X |
| 3,847,533 | 11/1974 | Riordan | 431/78 |

*Primary Examiner*—Edward G. Favors
*Attorney, Agent, or Firm*—Callard Livingston

[57] ABSTRACT

Flame supervisory method and apparatus in which a cross-checking relay system is controlled jointly by time-delay factors and a two-state control signal derived from the flame and having respectively pre-flame and flame-responsive polarity characteristics produced by reflexive bias and regenerative amplification and conversion of the basic flame-detection current to a control signal determining either switch-over to full flame burner operation or lock out of the system under ignition failure conditions. The two control states of the converted flame-detection signal are of a self-locking character, the pre-flame state tending to inhibit false response of the relay system to spurious flame signals, and the converted control signal in general being highly discriminative owing to an abrupt, non-linear change in polarity differentiating it from the pre-flame state.

19 Claims, 2 Drawing Figures

PRIMARY FLAME SAFEGUARD SYSTEM

Figure 1:
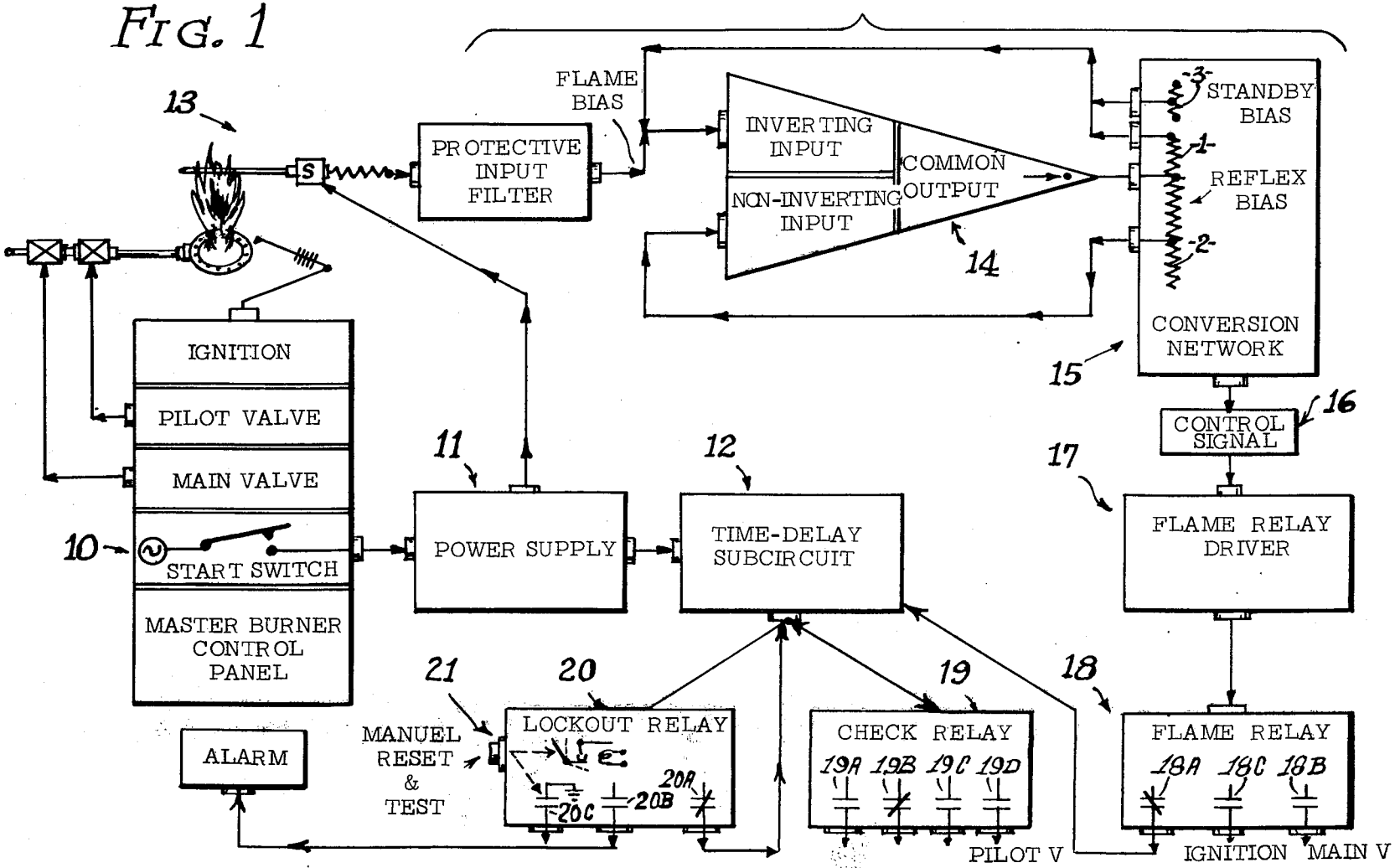

The disclosures provide a primary flame safeguard system having aspects of general utility in flame monitoring practices, and especially adapted to the supervision of the ignition phase of fuel burner operation. The invention is characterized by the provision of a method and apparatus for amplifying low-level flame-detection signals to produce a control signal having two discriminative output states as the result of reflexive and regenerative feedback of the common output of respectively inverting and non-inverting inputs in conjunction with reflex biasing effects fed back from an associated output or conversion network traversed by the common amplifier output resulting from the two inputs.

The operation of the novel flame signal amplifying means is such that in an idle or pre-flame standby state the effective or resultant common output constitutes a pre-flame state or signal which is of a polarity tending to inhibit actuation of an associated supervisory relay means, while appearance of a flame in a successful ignition trial causes the control output to change abruptly to the second or flame-responsive state with such amplitude and reversal of polarity that the resultant control signal in the second state will dependably effect the requisite response in a cross-checking relay system in confirmation of flame presence, along with other circuit conditions necessary to permit switch-over to full-flame operation of the burner or, in case of failure after an ignition trial, to lock out the system against further ignition trials until a mandatory manual resetting operation is effected.

Flame supervisory and monitoring systems in general depend upon relatively feeble and often unstable flame detection currents commonly derived from flame-conduction rods, photoelectric scanners, and like flame-sensing arrangements which characteristically yield low-level flame-detection signals requiring considerable amplification and modification for dependable use in safety supervisory applications, the utilization of which also requires introduction of time-delay factors of one kind or another to guard against premature or false response to spurious and indefinite flame signals and various abnormal circuit and operating conditions and component failure.

It is accordingly a principal object of the invention to provide a flame safeguard system embodying methods and apparatus for reflexive amplification and conversion of the usual flame-detection signals to produce a dependable resultant control signal of high amplitude and definitely discriminative character having general utility in flame monitoring practice but especially effective to supervise the ignition phase of fuel burner operation.

It is a further object to provide a simple cross-checking relay system consisting of a trio of relays and associated time-delay means responsive to flame-detection signals and predetermined circuit conditions to permit or prevent switch-over to full flame operation dependently upon presence or absence of the requisite flame and circuit conditions and to effect a lock out of the system against recycling for further ignition trial until a mandatory manual resetting operation is effected, with provision nevertheles for further ignition trial provided no lock out occurs.

It is still further an object to govern the response of the relay system by the converted control signal afforded by the aforesaid flame-detection signal conversion means, jointly with a form of time-delay means operative in a way which causes one or the other of two of the three relays to respond as the result of the ignition trial depending upon whether the remaining relay of the array is or is not actuated by the flame-originating control signal within certain time limits.

In accordance with one aspect of the invention a flame-signal conversion amplifier has a common output resulting from dual inputs one of which is inverting and the other of which is non-inverting, and the common output is operative in a conversion network to produce reflex bias voltages which are fed back to the two inputs, further bias derived in part from the flame-detection signal and in part from a constant standby source independent of the reflex bias, being effective at one of said inputs in a way such that in the absence of flame bias the common output tends to be self-sustaining and locking in a first or standby state to produce a control output or signal which is of a magnitude and polarity which tends to inhibit a required response in an associated supervisory relay system, the common output resulting from combined effects of said flame-originated bias and the reflex biases nullifying the standby bias and causing the common output to change abruptly to the second state with change of polarity and increase in magnitude of the resultant control signal such as will cause the aforesaid required response in said relay system, whereby the latter is governed to operate in different ways depending upon the presence or absence of said flame-originated bias and the related change in the state of the control signal as aforesaid.

In accordance with a further aspect of the invention, the supervisory relay means comprises a simple set of three supervisory relays respectively designated for reference as the *Flame Relay*, the *Check Relay*, and the *Lockout Relay*, arranged in a cross-checking, fail-safe operational array to be governed in part by flame-originated control signals, and in part by associated time-delay subcircuit means for operation in such manner that, responsive to a cycling or starting command which may take the form of application of power to the safeguard system, a primary time-delay guard interval afforded by said subcircuit means begins to run, and at the expiration of such guard interval the *Check Relay* must respond, depending upon whether the *Flame Relay* has operated within a further or secondary guard interval, if at all, and whether other predetermined circuit conditions are present, to permit switch-over to full flame burner operation, or whether failure conditions exist, in which case the *Lockout Relay* responds to shut down the system and lock itself against further operation pending mandatory manual resetting thereof.

Figure 2:
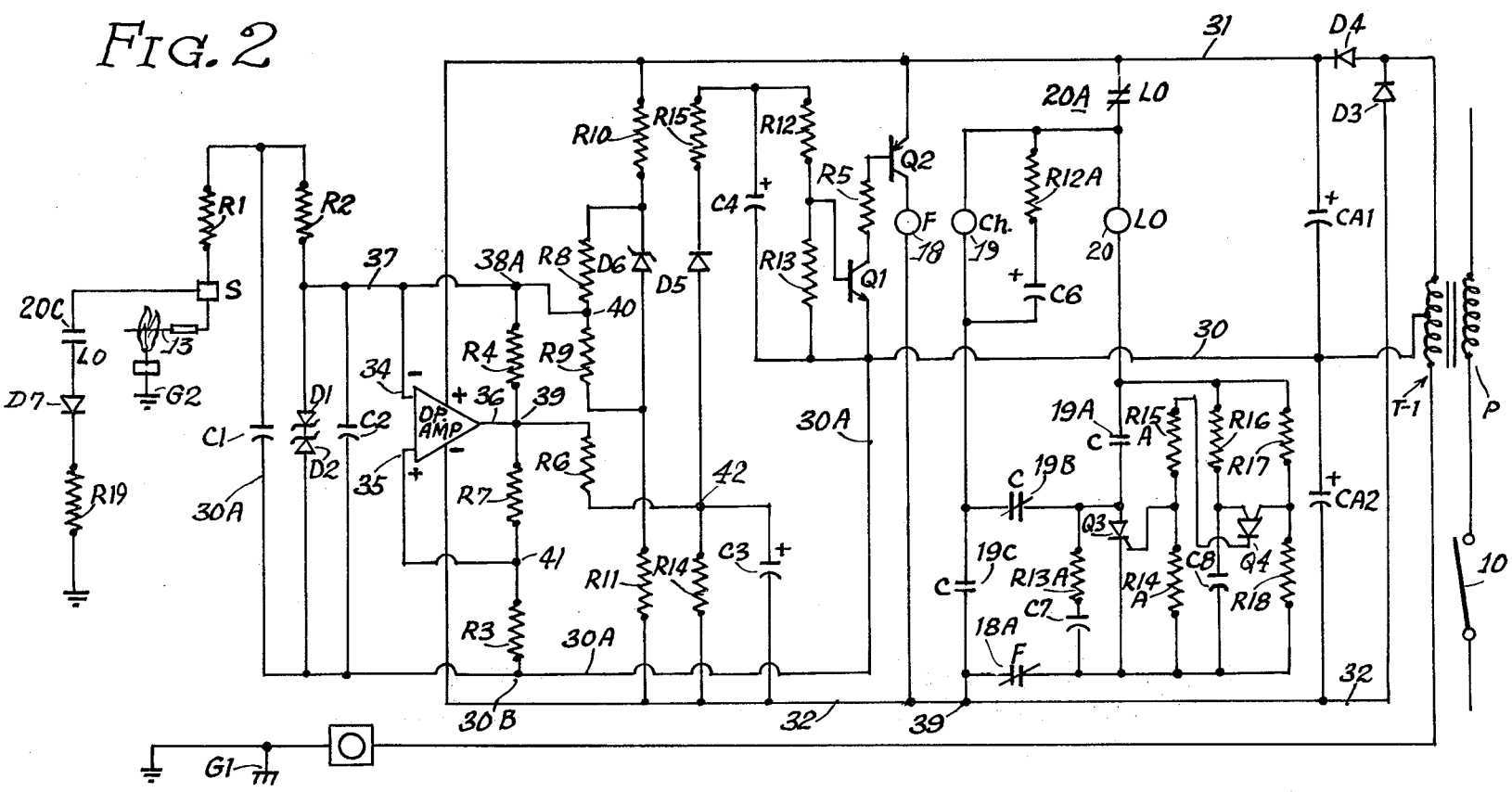

More detailed aspects of the character of the method and apparatus and the operation thereof will appear as the following description of a preferred embodiment thereof proceeds in view of the annexed drawings in which:

FIG. 1 is a block diagram illustrative of the flame safeguard method and circuit means adapted to use in conjunction with conventional fuel burner equipment; and FIG. 2 is a schematic circuit diagram of the safeguard system.

The block diagram of FIG. 1 illustrates the generalized functional aspects and circuit means of the safeguard system in conjunction with known cycling and limit switch means employed in conventional fuel burner installations to control the operation of pilot and main fuel valves and the usual ignition means, such known control components being collectively designated under the legend "Master Burner Controls" and including, among other instrumentalities, some form of cycling or "Starting Switch" 10 which will be operative in response to a start-up command or a call for heat to serve the dual purposes of cycling the safeguard system and setting up circuit conditions for the ignition trial, which will begin and continue for a 15-second interval corresponding to the 15-second guard interval of the relay system provided for the detection of malfunction and various abnormal circuit conditions, the presence or absence of which will govern the response of the supervisory relay system consisting, as aforesaid, of an array of three relays, the "Flame Relay" 18, "Check Relay" 19, and "Lockout Relay" 20, the Flame Relay being essentially responsive to flame conditions, while the Check and Lockout Relays are essentially responsive to time delay factors, the Check Relay serving essentially to check the condition or responses of the other two relays at the expiration of a 15-second guard interval provided by a "Time-Delay Subcircuit" 12 to determine whether full-flame switch-over shall be permitted or the ignition trial shall be terminated with lockout of the system, the Lockout Relay being of known type which is self-latching and requires a manual resetting in order to restore it to operative condition, which will permit further ignition trial, as indicated at 21, and which is also of a character such that it cannot be manually held in to prevent lockout action where ignition cannot be effected.

Operation of the Starting Switch 10 cycles or activates the safeguard system by energizing its Power Supply 11, which in turn activates the Time-Delay Subcircuit means 12 to start the aforesaid guard interval running and applies operating voltage to the flame-sensing means shown in the illustrative embodiment as a "Flame Rod" 13 which, in the presence of a flame will provide a rectified or substantially unidirectional flame-detection current or signal, such signal being applied to a particular one of the inputs of a special dual-input reflexive amplifying means 14 through a "Protective Input and Filter Circuit".

As seen in FIG. 1, the dual inputs of the amplifier are respectively an "Inverting Input" and a "Non-Inverting Input", both producing a "Common Output", such that in accordance with the polarity of the input energy respectively applied to each, the inputs will produce respectively Reversed and Non-Reversed magnified outputs in the "Common Output" circuit. Stated otherwise, the Non-Inverting Input produces an output of the same polarity as such input, while the Inverting Input produces an output of reversed polarity, both inputs effecting amplification and, to the extent in which they act simultaneously in the "Common Output" contributing to a net resultant output constituting the ultimate Control Signal which is the total or algebraic sum, with respect to polarity and magnitude, of the combined individual inputs.

The Common Output, as indicated in FIG. 1, is fed into an output network designated for identification as the "Conversion Network" 15, which includes voltage-dividing means traversed by the resultant Common Output current to produce corresponding "Reflex Biases" -1- and -2-; there being included a third "Standby Bias" -3- of fixed charcter supplied from a d.c. source such as the aforesaid "Power Supply", which is constant and independent of the "Reflex Bias" sources.

The respective "Reflex Biases" are applied to the two amplifier inputs as feed back from the network, while the constant-voltage "Standby Bias" is applied only to the Inverting Input to bias and sensitize the latter in its pre-flame, Standby condition pending appearance of a flame, which will then provide "Flame Bias" of such polarity and magnitude as will nullify the Standby Bias at the Inverting Input during such time as a flame remains present at Flame Rod 13.

The resultant Common Output of the special converting amplifier is made available at an output terminal 16 of the Conversion Network and is designated as the "Control Signal", and will reflect the two output states corresponding respectively to the standby or pre-flame condition and the "Flame-Responsive" condition of the system.

With a flame present, the Flame Rod 13 becomes the anode of a rectifying means with the grounded base of the burner, the cathode connecting with the common ground of the amplifier, the Flame Rod being connected through suitable load Input Coupling and protective resistance means to develop the Flame-Detection current or signal which will act at the Inverting Input to make the latter postivie-going, and by inversion, then cause the output from this particular input to become negative, it being observed that the polarity of the Standby Bias acting at the Inverting Input is likewise positive-going so that the net effect of the Common Output resulting from all of the bias acting at the Inverting Input, considered alone and when a flame is absent, will be approaching negative with respect to ground and of improper polarity to affect the relay system.

Under these same "flame absent" conditions, the reflex bias fed back from the Conversion Network 15 and acting concurrently at the Non-Inverting Input, will likewise produce an output approaching the negative in the Common Output, so that the total result of the Standby Bias fed back to both inputs tends to maintain or lock the amplifier in this first or Pre-Flame or Standby State pending appearance of a flame, the principal purpose of the Standby Bias being to set the Inverting Input bias at such a value and polarity as will afford optimal sensitivity to the Flame Bias when it appears, the occurrence of this event — that is the appearance of Flame Bias — serving to nullify the standby conditions existing during the pre-flame state at the Inverting Input, and thereby to throw the amplifier output abruptly into the second or Flame-Responsive state with a nearly instantaneous change in polarity of the Common Output and the resultant Control Signal, such abrupt change-over action occurring because of the rising, flame-caused positive-going polarity at the Flame Rod which renders the Inverting Input negative-going and, as the consequence of inversion, renders the Common Output increasingly positive due to the Feedback effect on the Non-Inverting Input, for which the value of the reflex bias is purposely lower than that for the Inverting Input, as will appear more fully hereinafter, so that the consequently amplified positive reinforcement of the positive state of the Common Output contributes cumulatively to the regenerative maintenance of this flame-responsive state until such time as the flame is extinguished or the safeguard system shut off.

The resultant control signal from the network signal output 16 in the flame-responsive state is of a polarity capable of actuating the Flame Relay Driver Amplifier 17 which comprises transistor means responsive only to gating bias of that polarity and, in effect, is inhibited from actuating the Flame Relay by bias of opposite polarity, such as that existing at output 16 in the pre-flame state.

Since the safeguard Power Supply Means 11 is activated at the start of the cycle, it is evident that the resultant output of the foregoing flame-signal detection and conversion methods can cause the Flame Relay to operate at the beginning of any 15-second guard interval if a previously-existing flame happens to be present, or if the Flame Rod is short-circuited or some other malfunction or component failure simulates a "flame present" condition (normally after a collateral 3-second guard interval, as will more fully appear), in which case the system will not start at all because power for the timing subcircuit will be cut off by the Flame Relay at contacts 18A, and the Timer Subcircuit will then be without operating power and cannot supply the requisite operating pulse for either the Check Relay or the Lockout Relay. Thus, the Flame Relay checks for the flame condition in any cycle, both at the time the ignition trial is initiated, and as the result of such trail. It will also be evident that if the Lockout Relay has not been released or reset from a previous lockout operation, the system likewise cannot be started because LO contacts 20A will stand open under such non-reset conditions.

Detailed Circuit Means

FIG. 2 depicts a preferred circuit means embodying components and operations characteristic of the flame safeguard system generally described in view of FIG. 1, including the Power Supply 11, Principal Delay Means 12, Reflex Flame Conversion Amplifier 14, and its output Conversion Network 15, along with Supervisory Relay Means comprising the Flame Relay 18 and its Driver Amplifier 17, the Check Relay 19, and the Lockout Relay 20.

According to FIG. 2, the Power Supply Means 11 comprises a power transformer -T- having a primary winding -P- which will be energized from the Master Control panel responsive to actuation of the cycling or Starting Switch 10, as heretofore generally described.

The secondary winding of the transformer has one terminal connected to common ground at G1 and another terminal providing high voltage for the Flame Rod 13 and connecting to the latter via conductors 30, 30A, Capacitor C1 (0.33 mfd), Load Resistor R1 (100 K ohms), the Signal Terminal -S-, and the Flame Rod 13.

Means such as Zener Diodes D1, D2 (6.2 v.) provide protective by-pass against high voltage disturbance from the Flame Rod assembly, the burner base of which is grounded at G2.

A low-voltage d.c. supply for the safeguard system is provided by means such as Rectifying Diodes D3, D4, and associated Filter Capacitor means CA1 and CA2 powered from a low-voltage (9.6 v.) terminal on said transformer secondary and providing rectified d.c. supply on conductors 31, 32 from which the respective windings -F-, -Ch-, -LO- of the Supervisory Relays will be energized under control of converted flame signal energy and time-delay factors in the respects appearing hereafter.

The flame or conversion signal amplifier 14 is depicted in FIG. 2 as an Operational Amplifier deriving its principal d.c. supply from Supply Conductors 31, 32, and having an Inverting Input Terminal 34, a Non-Inverting Input Terminal 35, and an Output Terminal 36 common to both inputs and constituting, with the operational reference ground conductor 32, the common output circuit of the conversion amplifier.

The Inverting Input 34 connects with the Flame Rod output conductor 37 which constitutes with the reference ground conductor 30, the input circuit across which the inverting input is connected, a flame-signal capacitor C2 (0.05 mfd) being shunted across this input circuit to store a negative flame-detecting signal which will act as "flame bias" on appearance of a flame at the Inverting Input 34 in conjunction with certain other "reflex bias" voltages hereafter identified, to effect a switching of the conversion amplifier abruptly to its second or flame-responsive state.

The output or conversion network 15 includes voltage-dividing means traversed essentially by current from the common output and providing reflex bias voltages applied as feedback to the two inputs 34, 35, said voltage dividing means comprising resistance means R4 (15 M ohms), and R7 (1 M ohm) disposed in series as a shunt across the input leads to the two inputs at junctions 38A and 41 and having connection with the common output at junction 39, such that the common output current produces voltage drops in this array of appropriate polarity and magnitude to serve as "reflex" or "feedback" bias for the respective inputs, such bias voltages varying in response to the flame bias and regeneration effects, as will appear hereafter.

A further bias voltage, designated for identification as the "Standby Bias", is of constant polarity and substantially constant magnitude, and is derived from a further voltage dividing means comprising resistance R8 (2.5 M ohms) and R9 (2.5 M ohms) connecting in shunt across the d.c. power supply conductors 31, 32, through resistance R10 (2 K ohms), R11 (2 K ohms) the inverting amplifier input connecting at junction 40 therein and the common output connecting at junction 39 therein, such that a constant Standby Bias voltage of positive-going polarity and predetermined fixed magnitude set for maximum sensitivity is applied to said inverting input for the purpose of causing the common output contributed by such input to be, by inversion, negative-going in the pre-flame or standby state of the amplifier, it being particularly observed that such standby bias supports a regenerative effect in the output tending to augment and sustain such standby state, which it will do until such time as the appearance of flame bias nullifies the effect of this standby bias at the inverting input. The standby bias voltage is maintained substantially constant by means such as the Zener Diode D6 shunting R8 and R9.

In the standby or pre-flame state of the amplifier, the Non-Inverting Input is likewise subjected to reflex bias, which will be of negative-going polarity derived from Junction 41 in the network, and resulting in regenerative amplification of the voltage and augmentation of the negative polarity condition of the common output voltage in the first state, so that the tendency of the amplifier to remain locked in its first or pre-flame standby state is still further increased to stabilize the amplifier against false response to spurious input signal effects from various unpredictable sources, along with an inhibitory characteristic also attending such standby output, as will further appear hereinafter.

As indicated in the generalized description, the Flame Relay and more specifically the circuit means for energizing its winding -F-, FIG. 2, is made responsive only to control signals or pulses having the particular polarity of the common output signal in its second or flame-responsive state, this being achieved by means such as the Flame Relay Driver Amplifier 17 which is comprised of transistors Q1 and Q2 connected in the compementary symmetry configuration shown, which may conveniently take the form of a Darlington pair, the winding -F- of the Flame Relay being energized by collector current in the conductive state of Q2 gated by bias of the particular polarity supplied by the converted flame-detection control signal output of the conversion amplifier, derived from Junction 42 in the network, and pull-in Delay Capacitor C3 (20 mfd) acting at the base of Q1 through diode 5 and Resistance Means R15 (33 K ohms) and R12 (12 K ohms).

A timing shunt consisting of capacitor C4 (2 mfd) and resistor R13 (220 K ohms) across the base circuit Q1, provides a drop-out delay for the Flame Relay of about 0.8 second, while the flame response of this relay is deferred by pull-in time-delay guard interval of 3 seconds provided by delay means such as capacitor C3 (20 mfd) and resistor R6 (90 K ohms) in order that an ample flame signal can be established and detected before the Flame Relay will respond.

Thus, it will appear that the Flame Relay is essentially responsive to flame conditions and the basic flame-detection signal afforded by whatever flame-sensing means is utilized, whether a conventional flame rod, ultraviolet or like photoelectric scanner, or other conventional flame-sensing means. The system is responsive to any flame-sensing means which will provide a signal as low as 2 microamperes. If desired both U.V. and Flame-Rod sensing can be used together.

The Check and Lockout Relays, as the remaining two components of the set of three supervisory relays, are energized from supply conductor 31 through normally-closed Lockout Contacts 20A, subject to the interdependent cross-checking condition of other relay contacts and the time-delay factors. Thus, if L O contacts 20A open, supply voltage for both the Lockout and the Check Relays is interrupted and the system is disabled, such a condition, for example, corresponding to the Locked-out state of the Locking Relay. The Check Relay will also detect an open Lockout Relay coil.

The principal timing subcircuit which will provide the 15-second delay factor or guard intervals, comprises a gated relay means such as a Silicon Controlled Relay or SCR, Q3, and an associated gating or triggering means, such as the anode-gated transistor Q4, the anode trigger of which is pre-sensitized or set by a reference voltage source comprising resistance means R17 (200 K ohms) and R18 (300 K ohms), the value of which determine the peak voltage at which Q4 will be gated, the principal anode voltage for Q4 being delayed in rise time following turn-on of the Power Supply Means 11, by means such as resistance R16 (8 M ohms) and capacitance C8 (1.5 mfd) such that when the peak voltage is reached in 12- to 15-seconds following turn-on or cycling of the system, capacitor C8 will discharge through Q4 and provide triggering voltage through limiting resistance R15A (22 ohms) to gate Q3 and cause the Check Relay to pull in and lock itself at its holding contacts 19C.

A gate resistance R14A (1. K ohms) is provided to by-pass transients and inductive disturbances around the gate of Q3 for prevention of false triggering thereof; and means such as resistance 13A (10. ohms) and capacitance C7 (0.022 mfd) is likewise provided to prevent false triggering of Q3 due to voltage surge when the Power Supply 11 is first switched on.

The operation of the aforesaid timing means is such that within 12 to 15 seconds of the start of the cycle under normal conditions Q3 will be gated by triggering of Q4 thereby permitting current flow from conductor 31, LO contacts 20A through the winding Ch. of the Check Relay via its normally closed contacts 19B, the anode-cathode path through Q3, and through normally closed Flame Relay contacts to Junction 39 with the lower supply conductor 32 causing the Check Relay to operate.

In the event that a flame is already present, Flame Relay contacts 18A would stand open and the Check Relay would not operate as above described, so tht the system would not start at all. But if a flame is not already present, the Check Relay will pull in at the expiration of the initial guard interval and the ignition trial will start and remain on for another 15 seconds as the result of closure of Check Relay contacts 19D and normally closed Flame Relay contacts 18C, FIG. 1, causing the pilot valve to open and ignition coil to be energized.

Operation of the Check Relay as aforesaid restarts the timing operation as the result of quenching or dropping out the SCR Q3 by closure of Check Relay contacts 19C in such relay operation, Check Relay contacts 19A now being closed so that the SCR can fire again if a further trigger pulse is received from Q4, which will appear at the expiration of this trial interval unless a flame is detected first to actuate the Flame Relay before this event can occur, it being observed that Check Relay contacts 19C are arranged to close before its contacts 19B open to assure against a nuisance lockout.

When a flame appears, the control signal provided by the Conversion Amplifier means will activate the Driver Amplifier Means Q1, Q2, as previously explained, and, following a short cautionary delay of about 3 seconds provided by the described pull-in delay means, the Flame Relay will operate and open its normally-closed power-control contacts 18A, thereby preventing any gating of Q3 and inhibiting operation of the Lockout Relay.

As a further result of the foregoing operation of the Flame Relay, the Main Valve contacts 18B thereof (FIG. 1) will close and activate the usual fuel switch-over valve means (not shown) in the Master Control unit to permit full-flame operation at the same time shutting off the ignition. It is preferred that the flame rod is exposed to the Pilot Flame in all installations.

If, however, a flame should fail to appear within the 15-second trial interval triggered by operation of the Check Relay, as aforesaid, then normally-closed Flame Relay contacts 18A would remain closed at the expiration of that time and as a result Q3 would be gated into conductivity and the Lockout Relay would operate and open its normally-closed power contacts 20A, thereby interrupting power to the timing means and both of the supervisory relays 18 and 19 and dropping out the holding circuit for the Check Relay at its contacts 19C with the system then standing in the "failed" or lockout condition and the Lockout Relay latched up pending manual reset.

in order to assure ample current for conduction of Q3 for positive response to energize and hold the relay during the transfer of power from Q3 to the Supply Source, Resistor R12A (100 ohms) and Capacitor C6 (6 mfd) are provided.

An important aspect of the conversion amplifying means is its discriminative acuity with sensitivity to low input signals without necessity of pre-amplification on the one hand, as against its tendency to maintain whichever of its two states it happens to be in notwithstanding such sensitivity on the other hand. This capability is due in substantial part to the sensitizing effect of the two resistors R8 (2.5 M ohms) and R9 (2.5 M ohms) which are especially balanced in production and further guarded by the voltage regulating diode means D6 in the network — and in part also to the feedback effects, together with the fact that the resultant control is qualitative rather than quantitative in character for actuation of the Flame Relay.

While the Lockout Relay 20 can take other forms, for example an electronic switch, it is preferred that this Relay shall be of the mechanical, self-latching type in order that this component may be mounted externally on the safeguard unit where it can be readily observed by operating personnel, and the manual reset or release button 21 (FIG. 1) is not only made operative to unlatch the relay but at the same time will close the test contacts 20C, thereby inserting a simulated flame signal into the sensing circuit by connecting the Flame Rod 13 to ground through a diode D7 and resistor R19 (2.5 M ohms), which, in case of certain component failures or shorts in the unit, will indicate if conversion amplifier 14, Power Supply 11 and units 15, 16, 17, 18, are functioning with a normal applied signal acting between the flame-sensing and ground the terminals -S- and -G2-.

Conveniently, the Operational Amplifier and its conversion network and voltage dividing means for both reflex and standby bias, together with the entire Drive Amplifier and the Power Supply diodes D1, D2, and filter capacitors C1, C2, may be combined in modular form as a first independent plug-in hybrid circuit unit; and the time-delay subcircuit means, including Q3, Q4 and associated R/C, buffering and protective or limiting resistors such as R13A, C7; R14A, R15A; R16, C8; and R17, R18, may be combined in a second plug-in hybrid module for convenience in manufacture and installation with the power transformer and supervisory relays as a very compact accessory unit adaptable to existing burner equipment for primary ignition safeguard purposes in large or small installations.

The flame-signal terminal -S- can be connected to any suitable flame-sensing means other than the popular flame-rod type — for example, to a U.V. scanner or any flame signal source providing a sensing signal in the 2 to 50 microampere range, at least. If desired, both flame rod and U.V. sensing can be used together in this system.

It is found convenient for manufacturing purposes to utilize a commercially available operational amplifier of the "741" type, or comparable packaged amplifying circuitry affording functions which can be utilized to produce a common output resultant from inputs which produce both inverted and non-inverted outputs, such for example as the "LM741/741C" type operational amplifier currently available from National Semiconductor Corporation, it being understood, nevertheless, that the amplifying means and circuitry may take other forms utilizing other available components arranged to meet the purposes and mode of operation of the disclosures in principle to maintain a marginal sensitizing input bias at the flame input, and provide a net resultant common output with reflex bias effective at the second input to swing the net resultant output in both amplitude and polarity to achieve discriminative acuity and produce the inhibitory tending stand-by conditions against false response in both the amplifier and relay driving circuit, as explained; it appearing further that the amplifying means itself has general application to flame monitoring and similar discriminative operations, and the relay and timing system has application in other types of flame safeguard equipment to perform the same or similar supervisory functions.

I claim:

1. The method of producing a control signal from a source of flame-detection current which comprises: deriving flame bias of predetermined polarity from said current; applying said flame bias to input means in a reflexive amplifying means having output means connecting into a conversion network operative to produce a plurality of reflex bias voltages of predetermined polarity and magnitude operative in said input means to produce a regenerative common output in said network and a resultant control signal available as output from said network and having two states of opposite polarity depending upon whether or not said flame bias acts in said input means, there being a first state in the absence of said flame bias which is of a first polarity, and a second state in the presence of said flame bias which is of a second and reverse polarity, said control signal having two states respectively corresponding to said first and second polarities.

2. The method of claim 1 further characterized by the provision of supervisory relay means and polarity-discriminative driver means therefor connecting with said network and operative responsive to said resultant control signal in one of said states to activate said relay means, and operative in the other of said states to inhibit activation of said relay means.

3. Flame responsive means comprising: a flame signal conversion amplifier having dual inputs one of which is inverting and one of which is non-inverting, both with respect to a common output, and both of which produce respectively amplified outputs in said common output; means providing an output network including voltage dividing means connecting with said inputs and said common output and traversed by common output energy to produce respective reflex bias voltages of predetermined polarity and magnitude, said respective reflex bias voltages being fed back regeneratively into respective ones of said inputs; furhter means providing a substantially constant standby bias voltage of predetermined polarity and magnitude applied to said inverting input; whereby said common output has a predetermined polarity and magnitude in a first state; means for applying to said inverting input flame bias of the opposite polarity from said standby bias, the magnitude of said standby bias being such as to be nullified in its effect on said inverting input in the presence of flame bias as aforesaid, whereby the common output responsive to such nullification becomes abruptly reversed in polarity in a second state to provide in said network a resultant control signal of predetermined polarity and of substantially greater amplitude than said flame bias.

4. Flame-responsive apparatus comprising: a conversion amplifier having an inverting input and a non-inverting input both delivering appertaining amplified output into a common output; conversion network means connecting with said common output and operative to produce reflex bias voltages of respectively predetermined polarity and magnitude, said bias voltages being fed back regeneratively into respective said inputs; means operative to produce a standby bias voltage of substantially constant magnitude and a predetermined polarity acting at said inverting input; means operative to apply flame-detection signal bias of predetermined polarity to said inverting input; said common output having a first pre-flame standby state in the absence of said flame bias such that the resultant common output is of a certain polarity, and having a second flame-responsive state in the presence of the flame bias operative at the inverting input as aforesaid and resulting from effective modification of the standby bias effects by the flame bias effects, whereby said common output and the resultant output available from said network is of polarity opposite from said certain polarity and of a magnitude substantially greater than that of said flame bias, said common output being available from said network as a resultant control signal in both said states.

5. Flame-responsive apparatus according to claim 4 wherein said conversion network means includes voltage-dividing resistance means in which current from said common output is operative to produce the plurality of reflex bias voltages as aforesaid.

6. Flame responsive apparatus according to claim 4 wherein the reflex bias voltage applied to said non-inverting input is of lesser value than that applied to said Inverting Input, and the output from the inverting input which results from nullification of the bias acting at the inverting input predominates in the common output so long as said flame bias is present at the inverting input.

7. Flame responsive apparatus according to claim 4 wherein the reflex bias applied to the inverting input is of positive polarity and the reflex bias applied to the non-inverting input is of negative polarity, and the standby bias is of positive polarity of predetermined fixed magnitude, such that the net effect in the common output available from said network as a control signal in the absence of flame bias as aforesaid is of negative polarity, the polarity of said flame bias being of negative polarity and being operative at said inverting input to nullify the effects of said standby bias and cause said common output to swing to positive polarity with magnitude substantially in excess of that of the flame bias, whereby the resultant output control signal available from said network is of positive polarity.

8. Flame-responsive apparatus according to claim 4 further characterized by the inclusion of supervisory relay means operatively controlled by said control signal and including a flame relay, and polarity-discriminative means driving said relay and responsive to control signals of positive polarity but not of negative polarity for purposes of actuating said flame relay.

9. Apparatus according to claim 8 further characterized in that said relay means further includes a check relay and a lockout relay and a source of operating power for said last-mentioned two relays, together with time-delay subcircuit means having connection with said two relays and said power and operative responsive to application of said power in a manner such that after a guard interval of predetermined time determined by said subcircuit means, the check relay operates; said flame relay when operated by said control signal controlling connection for said subcircuit means such that said operating power will be rendered ineffective to operate said lockout relay thereafter.

10. Apparatus according to claim 9 further characterized in that said lockout relay is of a type having automatic self-latching means operative on operation of the lockout relay to lock the same in a lockout condition requiring a resetting of said latching means before the apparatus can again be operated.

11. Apparatus according to claim 9 wherein said time-delay subcircuit means comprises first and second gated solid state conductive devices respectively having gating electrodes and an anode-cathode conductive path gated into conductivity by application of operating bias to the respective gating electrodes, and means responsive to application of power as aforesaid pre-sensitizing the gating electrode for one of said conductive devices and the anode-cathode path of such device having operating power connected thereto governed by said time-delay means and operative at the end of a predetermined time interval, constituting said guard interval, to cause said first conductive device to conduct at the expiration of such interval, and to apply gating voltage to the gating electrode of the second of said conductive devices, whereby operating power is made available for operation of the check and lockout relays at the expiration of said guard interval, and one or both of the other of said check and lockout relays being actuated thereoupon depending on whether said flame relay is operated within a predetermined interval following operation of said check relay.

12. In a flame ignition supervisory system, relay means responsive to flame signal control and comprising: a timing circuit responsive to starting power to define a first timing interval of predetermined duration; flame relay means, check relay means, and lockout relay means each having a normal non-operated and an operated state and respectively being in the non-operated state at the time of application of said starting power to initiate an ignition cycle; first circuit means operative responsive to flame-detection signals to actuate said flame relay to the operated state; said timing circuit being operative as a function of expiration of said first timing interval to actuate said check relay to the operated state, said check relay in the operated state being operative to initiate a second timing operation of said timing circuit to produce a second such timing interval; second circuit means operative responsive to the circuit conditions established by the check relay in said operated state thereof to cause actuation of said lockout relay means at the expiration of said second timing interval under the condition in which said flame relay means is not in the flame-responsive operated state aforesaid during the second but not the first said timing interval; said lockout relay means being operative in its operated state to disable the check relay, itself, and said timing circuit from further operation until the lockout relay means is restored to said normal non-operated state; said relay means being adapted to control conductive paths for governing predetermined actuation of ignition and fuel valve means in each ignition cycle, provided that said said check relay means and said flame relay means are in the operated state during said second timing interval and said lockout relay means remains in its normal non-operated state during such second interval, at least.

13. Apparatus according to claim 12 wherein said lockout relay is of the self-latching type requiring a manually-controlled resetting operation to restore it to said normal non-operated state whereby further operation of said relay means is prevented until said manually-controlled resetting operation is effected.

14. In a flame ignition system for a fuel burner, supervisory relay means responsive to flame-detection signals and comprising, in cooperative combination, a flame relay, a check relay and a lockout relay having respective non-operated and operated states; first circuit means responsive to flame detection signals to actuate said flame relay to the operated state; a timing circuit responsive to starting power applied thereto to delimit a first timing interval of predetermined duration; second circuit means governed by said timing circuit for actuating said check relay to the operated state as a function of expiration of said first timing interval; third circuit means effectuated by said check relay in the operated state thereof to activate said timing circuit a second time to delimit a second like timing interval; fourth circuit means operative under the condition in which said flame relay is in the non-operated state at the expiration of said second timing interval for actuation to cause said lockout relay to change to the operated state, said lockout relay in such operated state interrupting operating power for the check and lockout relays, at least, and remaining in said operated state thereafter until subjected to a resetting operation to restore it to its said non-operated state; fifth circuit means operative in the condition wherein said flame and check relays are in the operated state within the period of said second timing interval to prevent actuation of the lockout relay at the expiration of said second interval; and supervisory circuit means controlled by said relay means governing operation of ignition and fuel supply means for said fuel burner.

15. In flame safeguard apparatus, flame signal amplifying means accepting two inputs, and delivering respective first inverting and second non-inverting outputs into a common output circuit; voltage dividing network means traversed by current from said common output circuit and providing reflex bias fed back to act upon said inputs in magnitude and polarity to produce a regenerative common output in said common output circuit; means applying sensitizing standby bias to said first inverting input of a polarity and magnitude to produce an inverted standby output in said common output circuit of a predetermined small magnitude such that flame-signal bias of predetermined minimal magnitude will modify the effect of the standby bias and thereby cause a change in the reflex bias such as to produce an ultimate common output of increased magnitude and a polarity reversed from the polarity of the common output existing in the absence of said flame-signal bias, whereby to provide a flame-governed control signal available from said network.

16. Apparatus according to claim 15 above further characterized by the provision of a discriminative driving circuit means having an input circuit connecting with said network and normally biased against operative response to the effective polarity of the common output in the absence of flame bias as aforesaid, but responsive to the reverse polarity of the flame-responsive common output, and operating to provide a relay-driving voltage adaptable to the driving supervisory flame safeguard relay means.

17. In flame ignition and combustion safeguard apparatus adapted to be governed by presence or absence of flame-detection control signals arising from ignition trials, a supervisory relay system comprising: respectvie lockout, check and flame relay means each having a non-operated and operated state; a power source; a timing subcircuit activated by power from said source to repetitiously produce predetermined combustion trial timing intervals so long as said activating power thereto is uninterrupted; electron-conductive gating means triggerable from a normal non-conductive state to a conductive state responsive to a signal produced by said actuation of the timing subcircuit as a function of the conclusion of a timing interval thereof, actuation of the gating means as aforesaid causing actuation of the check relay means to the operated state; connections for said relay means and timing subcircuit operative such that said flame relay means is actuated to the operated state responsive to application thereto of said flame-detection control signals; said flame relay means in its operated state interrupting power from said source to said timing subcircuit and said lockout relay means to effect disablement of both; means operative under control of the check relay means in its operated state to establish a holding circuit to maintain such operated state; and means operated by the check relay means in its said operated state to interrupt operating power from said source to the check and lockout relay means and the timing subcircuit; at least one of the said relay means being adapted to control supervisory ignition and:or fuel means utilized in the said ignition trials.

18. The method of producing a flame-detection control signal from low-level flame detection signals which comprises: utilizing a solid-state electron flow means having first and second input circuits operative to produce a resultant output which is the function of such voltages as simultaneously act in said input circuits; a first one of said inputs being operative to invert the polarity resulting in said output from its input; applying flame-detection bias to said first input; applying standby bias to said first input in magnitude and polarity such that a predetermined range of flame bias acting at said first input will modify the effects of said standby bias, and cause an instantaneous change in polarity in said resultant output, the operation being such that in the absence of flame bias the effect of the stand-by bias is to make said resultant output of a predetermined inhibitory polarity, and in the presence of flame bias to modify the effect of the stand-by bias in a way to cause the resultant output to assume an opposite enabling polarity; feeding the resultant output into a bias circuit wherein the output current causes appearance of reflex bias; said reflex bias being applied to said inputs in a way causing change in the magnitude and polarity of said resultant output converting it suddenly into an enabling output constituting a desired control voltage adapted to actuate further flame supervisory and control means which is responsive to said enabling output but not to said inhibiting output.

19. The method of checking for flame ignition in a burner system having a start switch, ignition means, fuel control means, and a source of flame-detection signals which comprises, namely: providing a timing circuit and three relay devices respectively designated as the flame relay, the check relay, and the lockout relay, said method further comprising actuation of said timing circuit by said start switch to initiate a duty cycle including a first timing interval; exposing said flame relay to operation of said flame signals existing or occurring during said first timing interval; causing said first timing interval to be terminated responsive to operation of the flame relay at any time during such first timing interval; causing said check relay to be automatically operated at the expiration of said first timing interval in the absence of operation of the flame relay during such first interval; causing a further operation of the timing circuit to initiate a second timing interval following expiration of the first interval where the flame relay fails to operate prior to expiration of said first timing interval; causing said lockout relay to operate at the expiration of said second timing interval under the condition that the flame relay has not operated during either timing interval, and the check relay has operated at the expiration of said first timing interval; said lockout relay in the operated condition disabling the system from further duty cycle operation until the lockout relay is restored to non-operated condition, said relays in both non-operated and operated states controlling conductive paths governing predetermined operation of said ignition and fuel control means, at least.

* * * * *

UNITED STATES PATENT OFFICE
CERTIFICATE OF CORRECTION

PATENT NO. : 4,000,961
DATED : January 4, 1977
INVENTOR(S) : Richard F. Mandock

It is certified that error appears in the above-identified patent and that said Letters Patent are hereby corrected as shown below:

Column 5, line 24, for "trail" read --trial--; column 7, line 7, for "compementary" read --complementary--; column 8, line 17, for "tht" read --that--; column 12, line 61 (claim 12), delete (second) "said" before "check"; and column 14, line 65 (claim 19), for "of" read --by--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*